US009728173B2

(12) United States Patent
Watanabe

(10) Patent No.: US 9,728,173 B2
(45) Date of Patent: Aug. 8, 2017

(54) AUTOMATIC ARRANGEMENT OF AUTOMATIC ACCOMPANIMENT WITH ACCENT POSITION TAKEN INTO CONSIDERATION

(71) Applicant: YAMAHA CORPORATION, Hamamatsu-shi (JP)

(72) Inventor: Daichi Watanabe, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/262,625

(22) Filed: Sep. 12, 2016

(65) Prior Publication Data

US 2017/0084261 A1 Mar. 23, 2017

(30) Foreign Application Priority Data

Sep. 18, 2015 (JP) ..... 2015-185302

(51) Int. Cl.

*G10H 1/40* (2006.01)
*G10H 7/00* (2006.01)
*G10H 1/00* (2006.01)

(52) U.S. Cl.

CPC ..... *G10H 1/40* (2013.01); *G10H 1/0025* (2013.01); *G10H 2210/051* (2013.01); *G10H 2210/145* (2013.01)

(58) Field of Classification Search

CPC .. G10H 1/40; G10H 1/0025; G10H 2210/051; G10H 2210/145

(Continued)

(56) References Cited

U.S. PATENT DOCUMENTS 7,525,036 B2 * 4/2009 Shotwell ..... G10H 1/40 84/611
7,584,218 B2 * 9/2009 Miyajima ..... G10H 1/40

(Continued)

FOREIGN PATENT DOCUMENTS

JP 2005202204 A 7/2005
JP 2012203216 A 10/2012

OTHER PUBLICATIONS

Copending U.S. Appl. No. 15/262,548, filed on Sep. 12, 2016 (a copy is not included because the cited application is not yet available to the public and the Examiner has ready access to the cited application).

(Continued)

*Primary Examiner* — Jeffrey Donels
(74) *Attorney, Agent, or Firm* — Rossi, Kimms & McDowell LLP

(57) ABSTRACT

Performance information of main music is sequentially acquired, and an accent position of the music is determined. An automatic accompaniment is progressed based on accompaniment pattern data. Upon determination that the current time point coincides with the accent position, an accompaniment event whose tone generation timing arrives within a predetermined time range following the current time point is extracted from the accompaniment pattern data, the tone generation timing of the extracted accompaniment event is shifted to the current time point, and then, accompaniment data is created based on the accompaniment event having the tone generation timing thus shifted. If there is no accompaniment event whose tone generation timing arrives at the current time point or within the predetermined time range following the current time point, automatic accompaniment data with the current time point set as its tone generation timing is additionally created.

16 Claims, 3 Drawing Sheets

(58) Field of Classification Search
USPC ..... 84/611
See application file for complete search history.

(56) References Cited

U.S. PATENT DOCUMENTS

| | | | | |
|---|---|---|---|---|
| 9,251,773 | B2 * | 2/2016 | Buskies | G10H 1/0066 |
| 2015/0013527 | A1 * | 1/2015 | Buskies | G10H 1/40<br>84/611 |
| 2015/0013528 | A1 * | 1/2015 | Buskies | G10H 1/0041<br>84/611 |

OTHER PUBLICATIONS

Copending U.S. Appl. No. 15/262,594, filed on Sep. 12, 2016 (a copy is not included because the cited application is not yet available to the public and the Examiner has ready access to the cited application).

* cited by examiner

AUTOMATIC ARRANGEMENT OF AUTOMATIC ACCOMPANIMENT WITH ACCENT POSITION TAKEN INTO CONSIDERATION

BACKGROUND

The present invention relates generally to a technique which, on the basis of sequentially-progressing performance information of music, automatically arranges in real time an automatic accompaniment performed together with the performance information.

In the conventionally-known automatic accompaniment techniques, such as the one disclosed in Japanese Patent Application Laid-open Publication No. 2012-203216, a multiplicity of sets of accompaniment style data (automatic accompaniment data) are prestored for a plurality of musical genres or categories, and in response to a user selecting a desired one of the sets of accompaniment style data and a desired performance tempo, an accompaniment pattern based on the selected set of accompaniment style data is automatically reproduced at the selected performance tempo. If the user itself executes a melody performance on a keyboard or the like during the reproduction of the accompaniment pattern, an ensemble of the melody performance and automatic accompaniment can be executed.

However, for an accompaniment pattern having tone pitch elements, such as a chord and/or an arpeggio, the conventionally-known automatic accompaniment techniques are not designed to change tone generation timings of individual notes constituting the accompaniment pattern, although they are designed to change, in accordance with chords identified in real time, tone pitches of accompaniment notes (tones) to be sounded. Thus, in an ensemble of a user's performance and an automatic accompaniment, it is not possible to match a rhythmic feel (accent) of the automatic accompaniment to that of the user's performance, which would result in the inconvenience that only an inflexible ensemble is executable. Further, although it might be possible to execute an ensemble matching the rhythmic feel (accent) of the user's performance by selecting in advance an accompaniment pattern matching as closely as possible the rhythmic feel (accent) of the user's performance, it is not easy to select such an appropriate accompaniment pattern from among a multiplicity of accompaniment patterns.

SUMMARY OF THE INVENTION

In view of the foregoing prior art problems, it is an object of the present invention to provide an automatic accompaniment data creation apparatus and method which are capable of controlling in real time a rhythmic feel (accent) of an automatic accompaniment, suited for being performed together with main music, so as to match accent positions of sequentially-progressing main music.

In order to accomplish the above-mentioned object, the present invention provides an improved automatic accompaniment data creation apparatus comprising a processor which is configured to: sequentially acquire performance information of music; determine, based on the acquired performance information, whether a current time point coincides with an accent position of the music; acquire accompaniment pattern data of an automatic performance to be executed together with the music; and progress the automatic accompaniment based on the acquired accompaniment pattern data and create automatic accompaniment data based on an accompaniment event included in the accompaniment pattern data and having a tone generation timing at the current time point. Here, upon determination that the current time point coincides with the accent position, the processor extracts, from the accompaniment pattern data, an accompaniment event whose tone generation timing arrives within a predetermined time range following the current time point, then shifts the tone generation timing of the extracted accompaniment event to the current time point, and then creates the automatic accompaniment data based on the accompaniment event having the tone generation timing shifted to the current time point.

According to the present invention, in the case where an automatic accompaniment based on accompaniment pattern data is to be added to a sequentially-progressing music performance, a determination is made as to whether the current time point coincides with an accent position of the music represented by the performance information. Upon determination that the current time point coincides with the accent position, an accompaniment event whose tone generation timing arrives within the predetermined time range following the current time point is extracted from the accompaniment pattern data, the tone generation timing of the extracted accompaniment event is shifted to the current time point, and then automatic accompaniment data is created based on the accompaniment event having the tone generation timing shifted to the current time point. Thus, if the tone generation timing of an accompaniment event in the accompaniment pattern data does not coincide with an accent position of the music performance but is within the predetermined time range following the current time point, the tone generation timing of the accompaniment event is shifted to the accent position, and automatic accompaniment data is created in synchronism with the accent position. In this way, the present invention can control in real time a rhythmic feel (accent) of the automatic accompaniment, performed together with the music performance, so as to match accent positions of the sequentially-progressing music performance and can thereby automatically arrange the automatic accompaniment in real time.

In one embodiment of the invention, for creation of the automatic accompaniment data, the processor may be further configured in such a manner that, upon determination that the current time point coincides with the accent position of the music, the processor additionally creates automatic accompaniment data with the current time point set as a tone generation timing thereof, on condition that any accompaniment event whose tone generation timing arrives at the current time point or within the predetermined time range following the current time point is not present in the accompaniment pattern data. With this arrangement too, the present invention can control in real time the rhythmic feel (accent) of the automatic accompaniment, performed together with the music performance, so as to match accent positions of the sequentially-progressing music performance and can thereby automatically arrange the automatic accompaniment in real time.

The automatic accompaniment data creation apparatus of the present invention may be implemented by a dedicated apparatus or circuitry configured to perform necessary functions, or by a combination of program modules configured to perform their respective functions and a processor (e.g., a general-purpose processor like a CPU, or a dedicated processor like a DSP) capable of executing the program modules.

The present invention may be constructed and implemented not only as the apparatus invention discussed above but also as a method invention. Also, the present invention may be arranged and implemented as a software program for execution by a processor, such as a computer or DSP, as well as a non-transitory computer-readable storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
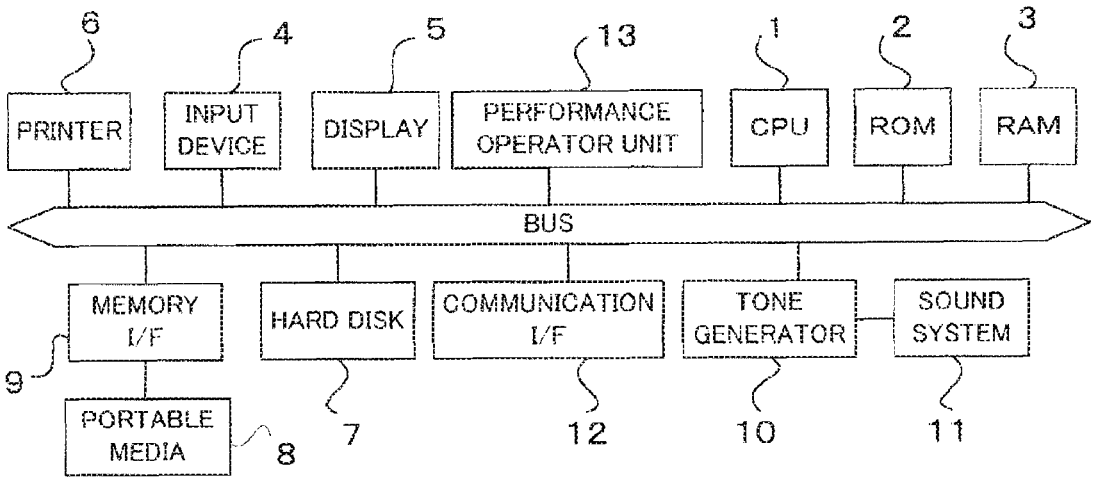
FIG. 1 is a hardware setup block diagram showing an embodiment of an automatic accompaniment data creation apparatus of the present invention.

FIG. 1 is a hardware setup block diagram showing an embodiment of an automatic accompaniment data creation apparatus of the present invention. The embodiment of the automatic accompaniment data creation apparatus need not necessarily be constructed as an apparatus dedicated to automatic accompaniment data creation and may be any desired apparatus or equipment which has computer functions, such as a personal computer, portable terminal apparatus or electronic musical instrument, and which has installed therein an automatic-accompaniment-data creating application program of the present invention. The embodiment of the automatic accompaniment data creation apparatus has a hardware construction well known in the art of computers, which comprises among other things: a CPU (Central Processing Unit) 1; a ROM (Read-Only Memory) 2; a RAM (Random Access Memory) 3; an input device 4 including a keyboard and mouse for inputting characters (letters and symbols), signs, etc.; a visual display 5; a printer 6; a hard disk 7 that is a non-volatile large-capacity memory; a memory interface (I/F) 9 for portable media 8, such as a USB memory; a tone generator circuit board 10; a sound system 11 including a speaker (loudspeaker) etc.; and a communication interface (I/F) 12 for connection to external communication networks. The automatic-accompaniment-data creating application program of the present invention, other application programs and control programs are stored in a non-transitory manner in the ROM 2 and/or the hard disk 7.

Figure 2:
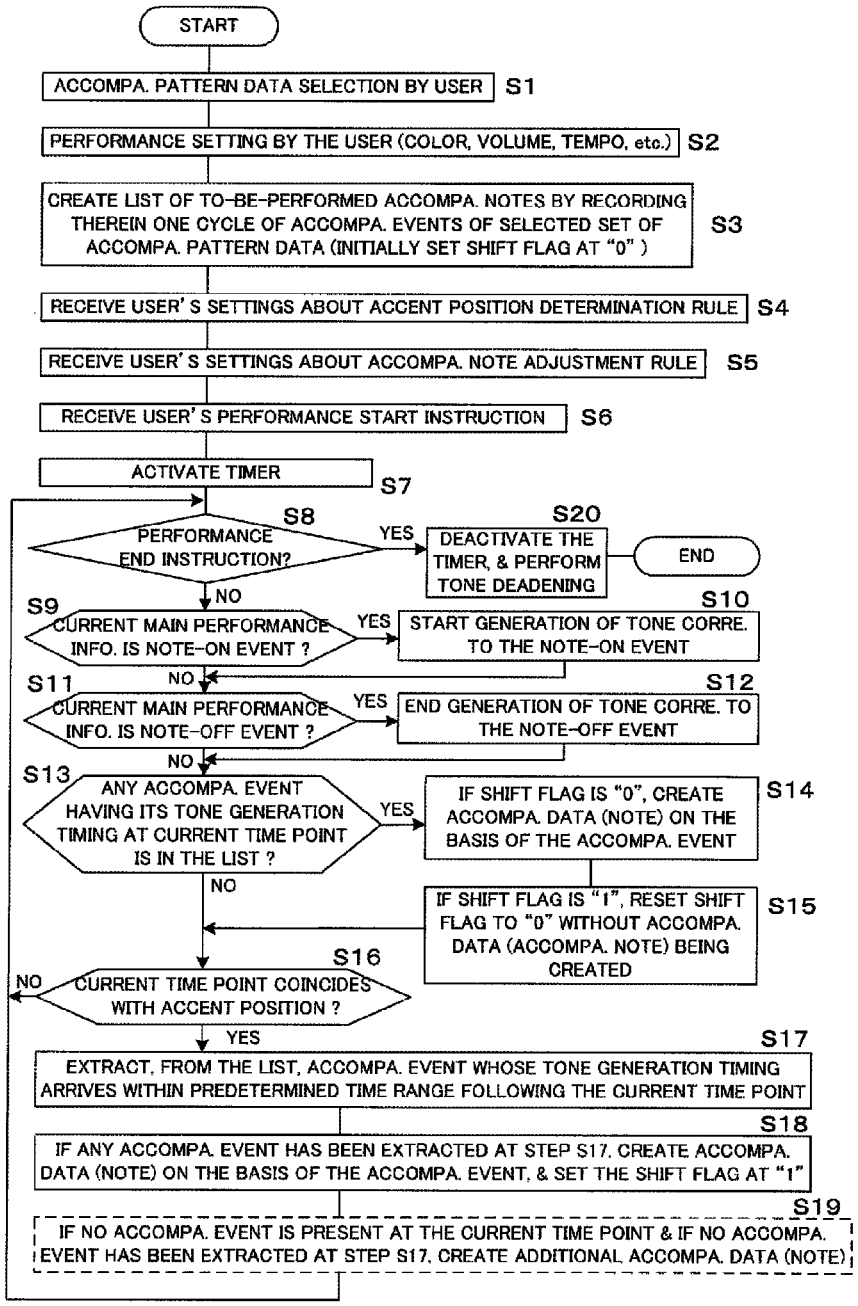
FIG. 2 is a flow chart explanatory of processing according to an embodiment of the present invention performed under the control of a CPU in the automatic accompaniment data creation apparatus.

The automatic accompaniment data creation apparatus shown in FIG. 1 further includes a performance operator unit 13, such as a music-performing keyboard, which allows a user to execute real-time music performances. The performance operator unit 13 is not necessarily limited to a type fixedly or permanently provided in the automatic accompaniment data creation apparatus and may be constructed as an external device such that performance information generated from the performance operator unit 13 is supplied to the automatic accompaniment data creation apparatus in a wired or wireless fashion. In the case where the performance operator unit 13 is fixedly provided in the automatic accompaniment data creation apparatus, for example, tones performed by the user on the performance operator unit 13 can be acoustically or audibly generated from the automatic accompaniment data creation apparatus via the tone generator board 10 and the sound system 11; an embodiment to be described in relation to FIG. 2 is constructed in this manner. In the case where the performance operator unit 13 is constructed as an external device, on the other hand, tones performed by the user on the performance operator unit 13 may be audibly generated from a tone generator and a sound system possessed by the external device or may be audibly generated from the automatic accompaniment data creation apparatus via the tone generator board 10 and the sound system 11 on the basis of performance information supplied from the performance operator unit 13 to the automatic accompaniment data creation apparatus in a wired or wireless fashion. Further, although, typically, automatic accompaniment notes based on automatic accompaniment data created in accordance with an embodiment of the present invention are acoustically or audibly generated (sounded) via the tone generator board 10 and the sound system 11 of the automatic accompaniment data creation apparatus, the present invention is not necessarily so limited, and such automatic accompaniment notes may be audibly generated via a tone generator and a sound system of another apparatus than the aforementioned automatic accompaniment data creation apparatus.

The following outline characteristic features of the embodiment of the present invention, before detailing the characteristic features of the embodiment. The instant embodiment, which is based on the fundamental construction that an automatic accompaniment based on an existing set of accompaniment pattern data (i.e., a set of accompaniment pattern data prepared or obtained in advance) is added to a main music performance, is characterized by creating automatic accompaniment data adjusted in tone generation timing in such a manner that a rhythmic feel (accent) of the automatic accompaniment is controlled in real time so as to match accent positions of the main music performance, rather than creating automatic accompaniment data corresponding exactly to the set of accompaniment pattern data.

FIG. 2 is a flow chart of processing according to an embodiment of the present invention performed under the control of the CPU 1. At steps S1 to S5 in FIG. 2, various presetting operations by the user are received. At step S1, a selection of a set of accompaniment pattern data for use as a basis of an automatic accompaniment to be added to a main music performance is received from the user. More specifically, the user selects, from an existing database, a set of accompaniment pattern data suitable for the main music performance to be provided, with a genre, rhythm, etc. of the main music performance taken into consideration. Let it be assumed that, in the illustrated example of FIG. 2, the set of accompaniment pattern data for use as the basis of the automatic accompaniment to be added to the main music performance comprises pattern data of a drum part that need not be adjusted in pitch. A multiplicity of existing sets of accompaniment pattern data (templates) are prestored in an internal database (such as the hard disk 7 or portable media 8) or in an external database (such as a server on the Internet), and the user selects a desired one of the prestored sets of accompaniment pattern data, with the genre, rhythm, etc. of the main music performance taken into consideration. Note that a same set of accompaniment pattern data need not necessarily be selected (acquired) for the whole of a music piece of the main music performance and a plurality of different sets of accompaniment pattern data may be selected (acquired) for different sections or portions, each having one or some measures, of the music piece. Alternatively, a combination of a plurality of sets of accompaniment pattern data to be performed simultaneously may be acquired simultaneously.

Note that, in the instant embodiment, a bank of known accompaniment style data (automatic accompaniment data) may be used as a source of the existing accompaniment pattern data. In such a bank of known accompaniment style data (automatic accompaniment data), a plurality of sets of accompaniment style data are prestored per category (e.g., Pop & Rock, Country & Blues, or Standard & Jazz). Each of the sets of accompaniment style data includes an accompaniment data set per section, such as an intro section, main section, fill-in section or ending section. The accompaniment data set of each of the sections includes accompaniment pattern data (templates) of a plurality of parts, such as rhythm 1, rhythm 2, bass, rhythmic chord 1, rhythmic chord 2, phrase 1 and phrase 2. Such lowermost-layer, part-specific accompaniment pattern data (templates) stored in the bank of known accompaniment style data (automatic accompaniment data) is the accompaniment pattern data acquired at step S1 above. In the instant embodiment, accompaniment pattern data of only the drum part (rhythm 1 or rhythm 2) is selected and acquired at step S1. The substance of the accompaniment pattern data (template) may be either data encoded dispersively in accordance with the MIDI standard or the like, or data recorded along the time axis, such as audio waveform data. Let it be assumed that, in the latter case, the accompaniment pattern data (template) includes not only the substantive waveform data but also at least information (management data) identifying tone generation timings. As known in the art, the accompaniment pattern data of each of the parts constituting one section has a predetermined number of measures, i.e. one or more measures, and accompaniment notes corresponding to the accompaniment pattern having the predetermined number of measures are generated by reproducing the accompaniment pattern data of the predetermined number of measures one cycle or loop-reproducing (i.e., repeatedly reproducing) the accompaniment pattern data of the predetermined number of measures a plurality of cycles during a reproduction-based performance.

Then, at step S2 are received user's performance settings about various musical elements, such as tone color, tone volume and performance tempo, of a main music performance which the user is going to perform in real time using the performance operator unit 13. Note that the performance tempo set here becomes a performance tempo of an automatic accompaniment based on the accompaniment pattern data. The tone volume set here includes a total tone volume of the main music performance, a total tone volume of the automatic accompaniment, tone volume balance between the main music performance and the automatic accompaniment, and/or the like.

Then, at step S3, a time-serial list of to-be-performed accompaniment notes is created by specifying or recording therein one cycle of accompaniment events of each of one or more sets of accompaniment pattern data selected at step S1 above. Each of the accompaniment events (to-be-performed accompaniment notes) included in the list includes at least information identifying a tone generation timing of the accompaniment note pertaining to the accompaniment event, and a shift flag that is a flag for controlling a movement or shift of the tone generation timing. As necessary, the accompaniment event may further include information identifying a tone color (percussion instrument type) of the accompaniment note pertaining to the accompaniment event, and other information. The shift flag is initially set at a value "0" which indicates that the tone generation timing has not been shifted.

At next step S4, user's settings about a rule for determining accent positions in the main music performance (accent position determination rule) are received. Examples of such an accent position determination rule include a threshold value functioning as a metrical criterion for determining an accent position, a note resolution functioning as a temporal criterion for determining an accent position, etc. which are settable by the user.

Then, at step S5, user's settings about a rule for adjusting accompaniment notes (i.e., accompaniment note adjustment rule) are received. Examples of such an accompaniment note adjustment rule include setting a condition for shifting the tone generation timing of the accompaniment event so as to coincide with an accent position of the main music performance (condition 1), a condition for additionally creating an accompaniment event at such a tone generation timing as to coincide with an accent position of the main music performance (condition 2), etc. The setting of such condition 1 and condition 2 comprises, for example, the user setting desired probability values.

At step S6, a performance start instruction given by the user is received. Then, at next step S7, a timer for managing an automatic accompaniment reproduction time in accordance with the performance tempo set at step S2 is activated in response to the user's performance start instruction. At generally the same time as the user gives the performance start instruction, he or she starts a real-time performance of the main music using, for example, the performance operator unit 13. Let it be assumed here that such a main music performance is executed in accordance with the performance tempo set at step S2 above. At the same time, an automatic accompaniment process based on the list of to-be-performed accompaniment notes is started to be performed in accordance with the same tempo as the main music performance. In the illustrated example of FIG. 2, generation of tones responsive to the main music performance by the user and generation of accompaniment tones responsive to the automatic accompaniment process is controlled by operations of steps S8 to S19 to be described below.

Then, at step S8, a determination is made as to whether a performance end instruction has been given by the user. If such a performance end instruction has not yet been given by the user as determined at step S8, the processing goes to step S9. At step S9, performance information of the main music performance being executed by the user using the performance operator unit 13 (such performance information will hereinafter be referred to as "main performance information") is acquired, and a further determination is made as to whether the current main performance information is a note-on event that instructs a generation start (sounding start) of a tone of a given pitch. If the current main performance information is a note-on event as determined at step S9, the processing proceeds to step S10, where it performs an operation for starting generation of the tone corresponding to the note-on event (i.e., tone of the main music performance). Namely, the operation of step S10 causes the tone corresponding to the note-on event to be generated via the tone generator circuit board 10, the sound system 11, etc. With a NO determination at step S9, or after step S10, the processing proceeds to step S11, where a determination is made as to whether the current main performance information is a note-off event instructing a generation end (sounding end) of a tone of a given pitch. If the current main performance information is a note-off event as determined at step S11, the processing proceeds to step S12, where it performs an operation for ending generation of the tone corresponding to the note-off event (well-known tone generation ending operation).

With a NO determination at step S11, or after step S12, the processing proceeds to step S13. At step S13, a further determination is made as to whether any accompaniment event having its tone generation timing at the current time point indicated by the current count value of the abovementioned timer (i.e., any accompaniment event for which generation of a tone is to be started at the current time point) is present in the list of to-be-performed accompaniment notes. With a YES determination at step S13, the processing goes to steps S14 and S15. More specifically, at step S14, if the shift flag of the accompaniment event having its tone generation timing at the current time point is indicative of the value "0", accompaniment data (accompaniment note) is created on the basis of the accompaniment event. Then, in accordance with the thus-created accompaniment data, waveform data of a drum tone (accompaniment tone) identified by the accompaniment data is audibly generated or sounded via the tone generator circuit boar 10, the sound system 11, etc.

At next step S15, if the shift flag of the accompaniment event having its tone generation timing at the current time point is indicative of the value "1", the shift flag is reset to "0" without accompaniment data being created on the basis of the accompaniment event. The shift flag indicative of the value "0" means that the tone generation timing of the accompaniment event has not been shifted, while the shift flag indicative of the value "1" means that the tone generation timing of the accompaniment event has been shifted to a time point corresponding to an accent position preceding the current time point. Namely, for the accompaniment event whose shift flag is indicative of the value "1", only resetting of the shift flag to "0" is effected at step S15 without accompaniment data being created again, because accompaniment data corresponding to the accompaniment event has already been created in response to the shifting of the tone generating timing of the accompaniment event to the time point corresponding to the accent position preceding the current time point.

With a NO determination at step S13 or following step S15, the processing proceeds to step S16. At step S16, an operation is performed, on the basis of the main performance information, for extracting an accent position of the main music performance, and a determination is made as to whether the current time point coincides with the accent position.

The operation for extracting an accent position from the main music performance may be performed at step S16 by use of any desired technique (algorithm), rather than a particular technique (algorithm) alone, as long as the desired technique (algorithm) can extract an accent position in accordance with some criterion. Several examples of the technique (algorithm) for extracting an accent position in the instant embodiment are set forth in items (1) to (7) below. Any one or a combination of such examples may be used here. The main performance information may be of any desired musical part (i.e., performance part) construction; that is, the main performance information may comprise any one or more desired musical parts (performance parts), such as: a melody part alone; a right hand part (melody part) and a left hand part (accompaniment or chord part) as in a piano performance; a melody part and a chord backing part; or a plurality of accompaniment parts like an arpeggio part and a bass part.

(1) In a case where the main performance information includes a chord part, the number of notes to be sounded simultaneously per tone generation timing (sounding timing) in the chord part (or in the chord part and melody part) is determined, and each tone generation timing (i.e., time position or beat position) where the number of notes to be sounded simultaneously is equal to and greater than a predetermined threshold value is extracted as an accent position. Namely, if the number of notes to be sounded simultaneously at the current time point is equal to and greater than the predetermined threshold value, the current time point is determined to be an accent position. Namely, this technique takes into consideration the characteristic that, particularly in a piano performance or the like, the number of notes to be simultaneously performed is greater in a portion of the performance that is to be emphasized more; that is, the more the portion of the performance is to be emphasized, the greater is the number of notes to be simultaneously performed.

(2) In a case where any accent mark is present in relation to the main performance information, a tone generation timing (time position) at which the accent mark is present is extracted as an accent position. Namely, if the accent mark is present at the current time point, the current time point is determined to be an accent position. In such a case, score information of music to be performed is acquired in relation to the acquisition of the main performance information, and the accent mark is displayed on the musical score represented by the score information.

(3) In a case where the main performance information is a MIDI file, the tone generation timing (time position) of each note-on event whose velocity value is equal to or greater than a predetermined threshold value is extracted as an accent position. Namely, if the velocity value of the note-on event at the current time point is equal to or greater than the predetermined threshold value, the current time point is determined to be an accent position.

(4) Accent positions are extracted with positions of notes in a phrase in the main performance information (e.g., melody) taken into consideration. For example, the tone generation timings (time positions) of the first note and/or the last note in the phrase are extracted as accent positions, because the first note and/or the last note are considered to have a strong accent. Alternatively, the tone generation timing (time position) of a highest-pitch or lowest-pitch note in a phrase is extracted as an accent position, because such a highest-pitch or lowest-pitch note too is considered to have a strong accent. Namely, if a tone generated on the basis of the main performance information generated at the current time point is extracted as an accent position in this manner, the current time point is determined to be an accent position. Note that the music piece represented by the original performance information comprises a plurality of portions and the above-mentioned "phrase" is any one or more of such portions in the music piece.

(5) A note whose pitch changes from a pitch of a preceding note greatly, by a predetermined threshold value or more, to a higher pitch or to a lower pitch in a temporal pitch progression (such as a melody progression) in the main performance information is considered to have a strong accent, and thus the tone generation timing (time position)

of such a note is extracted as an accent position. Namely, if a tone generated on the basis of the main performance information at the current time point is extracted as an accent position in this manner, the current time point is determined to be an accent position.

(6) Individual notes of a melody (or accompaniment) in the main performance information are weighted in consideration of their beat positions in a measure, and the tone generation timing (time position) of each note of which the weighted value is equal to or greater than a predetermined threshold value is extracted as an accent position. For example, the greatest weight value is given to the note at the first beat in the measure, the second greatest weight is given to each on-beat note at or subsequent to the second beat, and a weight corresponding to a note value is given to each off-beat note (e.g., the third greatest weight is given to an eighth note, and the fourth greatest weight is given to a sixteenth note). Namely, if a tone generated on the basis of the main performance information at the current time point is extracted as an accent position in this manner, the current time point is determined to be an accent position.

(7) Note values or durations of individual notes in a melody (or accompaniment) in the main performance information are weighted, and the tone generation timing (time position) of each note whose weighted value is equal to or greater than a predetermined value is extracted as an accent position. Namely, a note having a long tone generating time is regarded as having a stronger accent than a note having a shorter tone generating time. Namely, if a tone generated on the basis of the main performance information at the current time point is extracted as an accent position in this manner, the current time point is determined to be an accent position.

At step S16, an accent position may be extracted from the overall main musical performance or may be extracted in association with each individual performance part included in the main musical performance. For example, an accent position specific only to the chord part may be extracted from performance information of the chord part included in the main musical performance. As an example, a timing at which a predetermined number, more than one, of different tone pitches are to be performed simultaneously in a pitch range higher than a predetermined pitch in the main musical performance may be extracted as an accent position of the chord part. Alternatively, an accent position specific only to the bass part may be extracted from performance information of the bass part included in the main musical performance. As an example, a timing at which a pitch is to be performed in a pitch range lower than a predetermined pitch in the main musical performance may be extracted as an accent position of the bass part.

If the current position is not an accent position as determined at step S16, the processing reverts from a NO determination at step S16 to step S8. If the current position is an accent position as determined at step S16, on the other hand, the processing proceeds from a YES determination at step S16 to step S17. At step S17, an accompaniment event whose tone generation timing arrives within a predetermined time range following the current time point is extracted from the abovementioned list of to-be-performed accompaniment notes (selected set of accompaniment pattern data). The "predetermined time" range is a relatively short time length that is, for example, shorter than a quarter note length. At step S18, if any accompaniment event has been extracted at step S17 above, accompaniment data is created on the basis of the extracted accompaniment event, but also the shift flag of the accompaniment event that is to be stored into the list of to-be-performed accompaniment notes is set at "1". Then, in accordance with the created accompaniment data, waveform data of a drum tone (accompaniment tone) indicated by the accompaniment data is acoustically or audibly generated (sounded) via the tone generator circuit board 10, sound system 11, etc. Thus, according to steps S17 and S18, when the current time point is an accent position, the tone generation timing of the accompaniment event, present temporally close to and after the current time point (i.e., present within the predetermined time range following the current time point), is shifted to the current time point (accent position), so that accompaniment data (accompaniment notes) based on the thus-shifted accompaniment event can be created in synchronism with the current time point (accent position). In this way, it is possible to control in real time a rhythmic feel (accent) of the automatic accompaniment, which is to be performed together with the main music performance, in such a manner that the accent of the automatic accompaniment coincides with the accent positions of the sequentially-progressing main music performance, and thus, it is possible to execute, in real time, arrangement of the automatic accompaniment using the accompaniment pattern data. As an option, the operation of step S18 may be modified so that, if no accompaniment event corresponding to the current time point is present in the list of to-be-performed accompaniment notes (NO determination at step S13) but an accompaniment event has been extracted at step S17 above, it creates accompaniment data on the basis of the extracted accompaniment event and sets at the value "1" the shift flag of the accompaniment event that is to be stored into the list of to-be-performed accompaniment notes.

If no accompaniment event corresponding to the current time point is present in the list of to-be-performed accompaniment notes (i.e., NO determination at step S13) and if no accompaniment event has been extracted at step S17, additional accompaniment data (note) is created at step S19. Then, in accordance with the thus-created additional accompaniment data, waveform data of a drum tone (accompaniment tone) indicated by the additional accompaniment data is audibly generated (sounded) via the tone generator circuit board 10, sound system 11, etc. Thus, according to step S19, when the current time point is an accent position and if no accompaniment event is present either at the current time point or temporally close to and after the current time point (i.e., within the predetermined time range following the current time point), additional (new) accompaniment data (accompaniment note) can be generated in synchronism with the current time point (accent position). In this way too, it is possible to control in real time the rhythmic feel (accent) of the automatic accompaniment, performed together with the main music performance, in such a manner that the accent of the automatic accompaniment coincides with the accent positions of the sequentially-progressing main music performance, and thus, it is possible to arrange in real time the automatic accompaniment using accompaniment pattern data. Note that step S19 is an operation that may be performed as an option and thus may be omitted as necessary. After step S19, the processing of FIG. 2 reverts to step S8.

Note that, in a case where an accent position is extracted at step S16 above only for a particular performance part in the main music performance, the operation of step S17 may be modified so as to extract, from the list of to-be-performed accompaniment notes, an accompaniment event of only a particular musical instrument corresponding to the particular performance part at the extracted accent position. For example, if an accent position of the chord part has been extracted, the operation of step S17 may extract an accompaniment event of only the snare part from the list of to-be-performed accompaniment notes. In such a case, the tone generation timing of the accompaniment event of the snare part may be shifted at step S18, or accompaniment data of the snare part may be additionally created at step S19. Further, if an accent position of the bass part has been extracted, the operation of step S17 may extract an accompaniment event of only the bass drum part snare may be extracted from the list of to-be-performed accompaniment notes. In such a case, the tone generation timing of the accompaniment event of the bass drum part may be shifted at step S18, or accompaniment data of the bass drum part may be additionally created at step S19. As another example, accompaniment events of percussion instruments, such as ride cymbal and crash cymbal, in accompaniment pattern data may be shifted or additionally created. Furthermore, an accompaniment event of a performance part of any other musical instrument may be shifted or additionally created in accordance with an accent position of the particular performance part, in addition to or in place of an accompaniment event of the particular drum instrument part being shifted or additionally created in accordance with an accent position of the particular performance part as noted above. For example, in addition to an accompaniment event of the particular drum instrument part being shifted or additionally created in accordance with an accent position of the particular performance part as noted above, unison notes or harmony notes may be added in the melody part, bass part or the like. In such a case, if the particular performance part is the melody part, a note event may be added as a unison or harmony in the melody part, or if the particular performance part is the bass part, a note event may be added as a unison or harmony in the bass part.

During repetition of the routine of steps S8 to S19, the count time of the above-mentioned timer is incremented sequentially so that the current time point processes sequentially, in response to which the automatic accompaniment progresses sequentially. Then, once the user gives a performance end instruction for ending the performance, a YES determination is made at step S8, so that the processing goes to step S20. At step S20, the above-mentioned timer is deactivated, and a tone deadening process is performed which is necessary for attenuating all tones being currently audibly generated.

Note that, in relation to each one-cycle set of accompaniment pattern data recorded in the list of to-be-performed accompaniment notes, the number of cycles for which the set of accompaniment pattern data should be repeated may be prestored. In such a case, processing may be performed, in response to the progression of the automatic accompaniment, such that the set of accompaniment pattern data is reproduced repeatedly a predetermined number of times corresponding to the prestored number of cycles and then a shift is made to repeated reproduction of the next set of accompaniment pattern data, although details of such repeated reproduction and subsequent shift are omitted in FIG. 2. Note that the number of cycles for which the set of accompaniment pattern data should be repeated need not necessarily be prestored as noted above, and the processing may be constructed in such a manner that, when the set of accompaniment pattern data has been reproduced just one cycle or repeatedly a plurality of cycles, the reproduction is shifted to the next set of accompaniment pattern data in the list in response to a shift instruction given by the user, although details of such an alternative too are omitted in FIG. 2. Further, as another alternative, each of the sets of accompaniment pattern data may be recorded in the list repeatedly for its respective necessary number of cycles, rather than for just one cycle.

When the CPU 1 performs the operations of steps S9 and S11 in the aforementioned configuration, it functions as a means for sequentially acquiring performance information of the main music performance. Further, when the CPU 1 performs the operation of step S16, it functions as a means for determining, on the basis of the acquired performance information, whether the current time point coincides with an accent position of the main music performance. Further, when the CPU 1 performs the operation of step S1, it functions as a means for acquiring accompaniment pattern data of an automatic performance to be performed together with the main music performance. Furthermore, when the CPU 1 performs the operations of steps S13, S14, S15, S17 and S18, it functions as a means for progressing the automatic accompaniment on the basis of the acquired accompaniment pattern data and creating automatic accompaniment data on the basis of an accompaniment event in the accompaniment pattern data which has its tone generation timing at the current time point, as well as a means for, when it has been determined that the current time point coincides with the accent position of the main music performance, extracting, from the accompaniment pattern data, an accompaniment event whose tone generation timing arrives within the predetermined time range following the current time point, shifting the tone generation timing of the extracted accompaniment event to the current time point and then creating automatic accompaniment data on the basis of the extracted accompaniment event having the tone generation timing shifted as above. Furthermore, when the CPU 1 performs the operation of step S19, it functions as a means for, when it has been determined that the current time point coincides with the accent position of the main music performance, additionally creating automatic accompaniment data with the current time point set as its tone generation timing if any accompaniment event whose tone generation timing arrives at the current time point or within the predetermined time range following the current time point is present in the accompaniment pattern data.

Figure 3A:
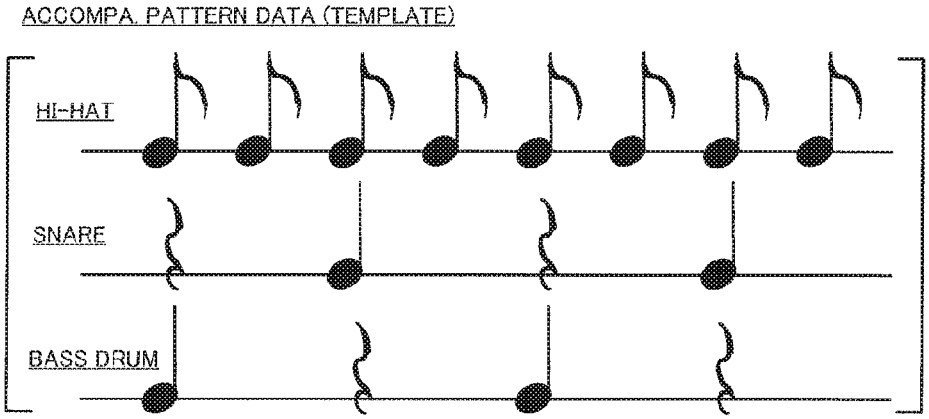
FIGS. 3A, 3B and 3C are diagrams showing an example specific manner in which arranged accompaniment data is created in the embodiment of FIG. 2.
Figure 3B:
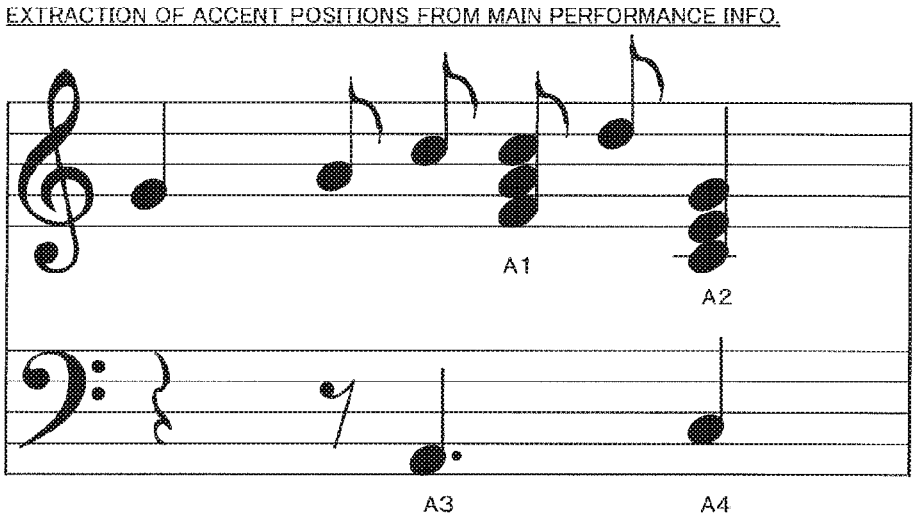
Figure 3C:
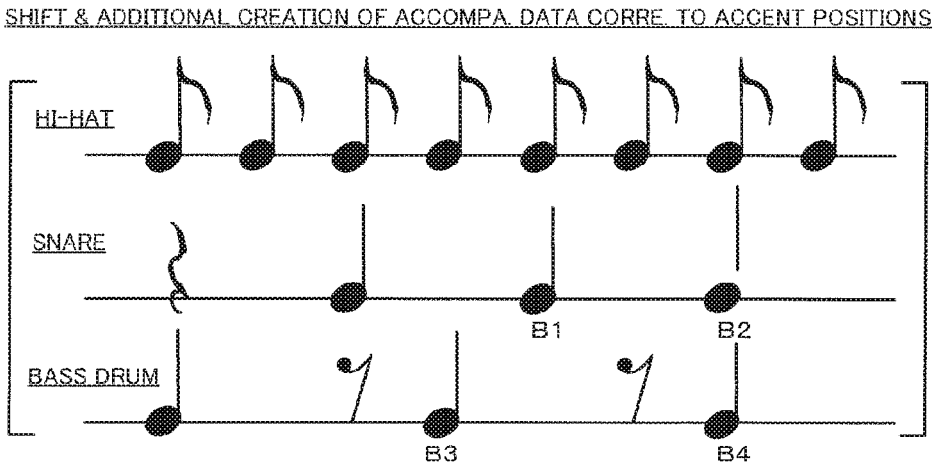

The following describe, with reference to FIGS. 3A to 3C, a specific example of the automatic accompaniment data creation in the aforementioned embodiment. FIG. 3A shows an example of the set of accompaniment pattern data selected by the user at step S1 above, which represents a pattern of notes of three types of percussion instruments, i.e. high-hat, snare drum and bass drum. FIG. 3B shows examples of main performance information of one measure and accent positions extracted from the main performance information. More specifically, FIG. 3B shows an example manner in which accent positions are extracted in association with individual ones of the chord part and bass part in the main performance information. In the illustrated example of FIG. 3B, each tone generation timing in the main performance information at which three or more different pitches are present simultaneously in a high pitch range equal to and higher than a predetermined pitch (e.g., middle "C") is extracted as an accent position of the chord part at step S16 of FIG. 2; more specifically, in the illustrated example, tone generation timings A1 and A2 are extracted as accent positions of the chord part. Further, at step S16 of FIG. 2, each tone generation timing in the main performance information at which a performance note in a low pitch range lower than a predetermined pitch (e.g., middle "C") is present is extracted as an accent position of the bass part; more specifically, in the illustrated example, tone generation timings A3 and A4 are extracted as accent positions of the bass part. FIG. 3C shows a manner in which the tone generation timings of accompaniment data created on the basis of the accompaniment pattern data shown in FIG. 3A are shifted in accordance with the accent positions extracted as shown in FIG. 3B, as well as a manner in which additional accompaniment data is newly created.

When an accent position of the chord part has been extracted at tone generation timing A1, no accompaniment event of the snare part is present within the predetermined time range (e.g., time range of less than a quarter note length) following the current time point, and thus, no accompaniment event of the snare part is extracted from the list of to-be-performed accompaniment notes at step S17 above. Further, because no accompaniment event of the snare part is present at the current time point too, accompaniment data of the snare part is additionally created at step S19. The accompaniment data of the snare part thus additionally created at step S19 is shown at timing B1 in FIG. 3C.

When an accent position of the chord part has been extracted at tone generation timing A2, an accompaniment event of the snare part is present at the current time point too, and thus, accompaniment data of the snare part is created on the basis of the accompaniment event through the operation from a YES determination at step S13 to step S14. The accompaniment data of the snare part created at step S14 in this manner is shown at timing B2 in FIG. 3C.

Further, when an accent position of the bass part has been extracted at tone generation timing A3, an accompaniment event of the bass drum part is present within the predetermined time range (e.g., time range of less than a quarter note length) following the current time point, and thus, such an accompaniment event of the bass drum part is extracted from the list of to-be-performed accompaniment notes at step S17 above. Consequently, through the operation of step S18, the accompaniment event of the bass drum part is shifted to the current time point, and accompaniment data based on the accompaniment event is created at the current time point (timing A3). The accompaniment data of the bass drum part created in this manner is shown at timing B3 in FIG. 3C.

Further, when an accent position of the bass has been extracted at tone generation timing A4, no accompaniment event of the bass part is present within the predetermined time range (e.g., time range of less than a quarter note length) following the current time point, and thus, no accompaniment event of the bass part is extracted from the list of to-be-performed accompaniment notes at step S17 above. Further, because no accompaniment event of the bass part is present at the current time point too, accompaniment data of the bass part is additionally created at step S19. The accompaniment data of the bass part additionally created at step S19 in this manner is shown at timing B4 in FIG. 3C.

The following describe an example of the accompaniment note adjustment rule set at step S5 above. Here, instead of the tone generation timing of the accompaniment event being always shifted at step S18 or the additional accompaniment data being always created at step S19, the tone generation timing shift operation of step S18 or the additional accompaniment data creation operation of step S19 is performed only when a condition conforming to the accompaniment note adjustment rule set at step S5 has been established. For example, a probability with which the tone generation timing shift operation or the additional accompaniment data creation operation is performed may be set at step S5 for each part (snare, bass drum, ride cymbal, crash cymbal or the like) of an automatic accompaniment. Then, at each of steps S18 and S19, the tone generation timing shift operation or the additional accompaniment data creation operation may be performed in accordance with the set probability (condition).

The foregoing have described the embodiment where the main music performance is a real-time performance executed by the user using the performance operator unit 13 etc. However, the present invention is not so limited, and, for example, the present invention may use, as information of a main music performance (main performance information), performance information transmitted in real time from outside via a communication network. As another alternative, performance information of a desired music piece stored in a memory of the automatic accompaniment data creation apparatus may be automatically reproduced and used as information of a main music performance (main performance information).

Further, in the above-described embodiment, the accompaniment note (accompaniment tone) based on the accompaniment data created at steps S14, S18, S19, etc. is acoustically or audibly generated via the tone generator circuit board 10, sound system 11, etc. However, the present invention is not so limited; for example, the accompaniment data created at steps S14, S18, S19, etc. may be temporarily stored in a memory as automatic accompaniment sequence data so that, on a desired subsequent occasion, automatic accompaniment tones are acoustically generated on the basis of the automatic accompaniment sequence data, instead of an accompaniment tone based on the accompaniment data being acoustically generated promptly.

Further, in the above-described embodiment, a strong accent position in a music performance is determined, and an accompaniment event is shifted and/or added in accordance with the strong accent position. However, the present invention is not so limited, and a weak accent position in a music performance may be determined so that, in accordance with the weak accent position, an accompaniment event is shifted and/or added, or attenuation of the tone volume of the accompaniment event is controlled. For example, a determination may be made, on the basis of acquired music performance information, as to whether the current time point coincides with a weak accent position of the music represented by the acquired music performance information. In such a case, if the current time point has been determined to coincide with a weak accent position of the music, control may be performed, each accompaniment event whose tone generation timing arrives at the current time point or within the predetermined time range following the current time point is extracted from the accompaniment pattern data, and control may be performed, for example, for shifting the tone generation timing of the extracted accompaniment event from the current time point to later than the predetermined time range, or deleting the extracted accompaniment event, or attenuating the tone volume of the extracted accompaniment event. In this way, the accompaniment performance can be controlled to present a weak accent in synchronism with the weak accent of the music represented by the acquired music performance information.

This application is based on, and claims priority to, JP PA 2015-185302 filed on 18 Sep. 2015. The disclosure of the priority application, in its entirety, including the drawings, claims, and the specification thereof, are incorporated herein by reference.

What is claimed is:

1. An automatic accompaniment data creation apparatus comprising:

a memory storing instructions;

a processor configured to implement the instructions stored in the memory and execute:

a performance information acquiring task that sequentially acquires performance information of music;

a timing determining task that determines, based on the acquired performance information, whether a current time point coincides with an accent position of the music;

a selection task that selects accompaniment pattern data, from among a plurality of accompaniment pattern data, of an automatic performance to be executed together with the music based on the acquired performance information of music; and an accompaniment progress task that progresses the automatic accompaniment based on the selected accompaniment pattern data and creates automatic accompaniment data based on an accompaniment event included in the selected accompaniment pattern data and having a tone generation timing at the current time point, wherein, upon the timing determination task determining that the current time point coincides with the accent position:

an extracting task that extracts, from the accompaniment pattern data, an accompaniment event whose tone generation timing arrives within a predetermined time range following the current time point;

a shifting task that, upon the extracting task extracting the accompaniment event, shifts the tone generation timing of the extracted accompaniment event to the current time point; and a creating task that creates the automatic accompaniment data based on the accompaniment event having the tone generation timing shifted to the current time point by the shifting task.

2. The automatic accompaniment data creation apparatus as claimed in claim 1, wherein, upon the timing determination task determining that the current time point coincides with the accent position, the processor is further configured to execute a creating task that additionally creates automatic accompaniment data with the current time point set as a tone generation timing thereof, when no accompaniment event whose tone generation timing arrives at the current time point or within the predetermined time range following the current time point is present in the selected accompaniment pattern data.

3. The automatic accompaniment data creation apparatus as claimed in claim 1, wherein:

the processor is further configured to execute a shift condition receiving task that receives a shift creation condition for shifting the tone generation timing of the extracted accompaniment event to the current time point, and the shifting task shifts the tone generation timing of the extracted accompaniment event to the current time point upon meeting the set shift condition.

4. The automatic accompaniment data creation apparatus as claimed in claim 2, wherein the processor is further configured to execute:

a creation condition receiving task that receives a creation condition for additionally creating the automatic accompaniment data with the current time point set as the generation timing thereof, and a creating task that additionally creates the automatic accompaniment data with the current time point set as the tone generation timing thereof upon meeting the set creation condition.

5. The automatic accompaniment data creation apparatus as claimed in claim 1, wherein the performance information acquiring task sequentially acquires in real time the performance information of music performed on a performance operator in real time by a user.

6. The automatic accompaniment data creation apparatus as claimed in claim 1, wherein the timing determining task obtains a number of notes to be sounded simultaneously per tone generation timing in the acquired performance information, and extract, as an accent position, each tone generation timing where the number of notes to be sounded simultaneously is equal to or greater than a predetermined threshold value.

7. The automatic accompaniment data creation apparatus as claimed in claim 1, wherein the timing determining task:

acquires an accent mark to be indicated on a musical score in association with the acquired performance information; and extracts, as an accent position, a tone generation timing corresponding to the accent mark associated with the acquired performance information.

8. The automatic accompaniment data creation apparatus as claimed in claim 1, wherein the timing determining task extracts, as an accent position, a tone generation timing of each note event whose velocity value is equal to or greater than a predetermined threshold value from among note events included in the acquired performance information.

9. The automatic accompaniment data creation apparatus as claimed in claim 1, wherein:

the performance information represents a music piece comprising a plurality of portions, and the timing determining task extracts, based on at least one of positions or pitches of a plurality of notes in one of the portions in the acquired performance information, an accent position in the one of the portions.

10. The automatic accompaniment data creation apparatus as claimed in claim 1, wherein the timing determining task extracts, as an accent position, a tone generation timing of a note whose pitch changes from a pitch of a preceding note greatly, by a predetermined threshold value or more, to a higher pitch or lower pitch in a temporal pitch progression in the acquired performance information.

11. The automatic accompaniment data creation apparatus as claimed in claim 1, wherein the timing determining task weighs each note in the acquired performance information with a beat position, in a measure, of the note taken into consideration and extracts, as an accent position, a tone generation timing of each of the notes whose weighted value is equal to or greater than a predetermined threshold value.

12. The automatic accompaniment data creation apparatus as claimed in claim 1, wherein the timing determining task weighs a note value of each note in the acquired performance information and extracts, as an accent position, a tone generation timing of each of the notes whose weighted value is equal to or greater than a predetermined threshold value.

13. The automatic accompaniment data creation apparatus as claimed in claim 1, wherein:

the acquired performance information comprises a plurality of performance parts, and the timing determining task determines, based on performance information of at least one of the performance parts, whether the current time point coincides with an accent position of the music.

14. The automatic accompaniment data creation apparatus as claimed in claim 1, wherein:

the acquired performance information comprises at least one performance part, the timing determining task determines, based on performance information of a particular performance part in the acquired performance information, whether the current time point coincides with an accent position of the music, and the extracting task extracts the accompaniment event from the accompaniment pattern data of a particular accompaniment part predefined in accordance with a type of the particular performance part and the creating task creates the automatic accompaniment data based on shifting a tone generation timing of the extracted accompaniment event to the current time point coinciding with the accent position.

15. An automatic accompaniment data creation method using a processor, the method comprising:

a performance information acquiring step of sequentially acquiring performance information of music;

a timing determining step of determining, based on the acquired performance information, whether a current time point coincides with an accent position of the music;

a selection step of selecting accompaniment pattern data, from among a plurality of accompaniment pattern data, of an automatic performance to be executed together with the music based on the acquired performance information of music; and an accompaniment progress step of progressing the automatic accompaniment based on the selected accompaniment pattern data and creating automatic accompaniment data based on an accompaniment event included in the selected accompaniment pattern data and having a tone generation timing at the current time point, wherein, upon the timing determining step determining that the current time point coincides with the accent position, the:

an extracting step of extracting, from the accompaniment pattern data, an accompaniment event whose tone generation timing arrives within a predetermined time range following the current time point;

a shifting step of shifting the tone generation timing of the extracted accompaniment event to the current time point; and a creating step of creating the automatic accompaniment data based on the accompaniment event having the tone generation timing shifted to the current time point in the shifting step.

16. A non-transitory machine-readable storage medium storing a program executable by a processor to perform an automatic accompaniment data creation method, the method comprising:

a performance information acquiring step of sequentially acquiring performance information of music;

a timing determining step of determining, based on the acquired performance information, whether a current time point coincides with an accent position of the music;

a selection step of selecting accompaniment pattern data, from among a plurality of accompaniment pattern data, of an automatic performance to be executed together with the music based on the acquired performance information of music; and an accompaniment progress step of progressing the automatic accompaniment based on the selected accompaniment pattern data and creating automatic accompaniment data based on an accompaniment event included in the selected accompaniment pattern data and having a tone generation timing at the current time point, wherein, upon the timing determining step determining that the current time point coincides with the accent position:

an extracting step of extracting, from the accompaniment pattern data, an accompaniment event whose tone generation timing arrives within a predetermined time range following the current time point;

a shifting step of shifting the tone generation timing of the extracted accompaniment event to the current time point; and a creating step of creating the automatic accompaniment data based on the accompaniment event having the tone generation timing shifted to the current time point in the shifting step.

* * * * *